US006362796B1

(12) United States Patent
Bohlman

(10) Patent No.: US 6,362,796 B1
(45) Date of Patent: Mar. 26, 2002

(54) BROADBAND ANTENNA

(75) Inventor: Walter Bohlman, Berlin, MD (US)

(73) Assignee: BAE SYSTEMS Aerospace Electronics Inc., Lansdale, PA (US)

( * ) Notice: Subject to any disclaimer, the term of this patent is extended or adjusted under 35 U.S.C. 154(b) by 0 days.

(21) Appl. No.: 09/663,499

(22) Filed: Sep. 15, 2000

(51) Int. Cl.[7] ..... H01Q 1/36
(52) U.S. Cl. ..... 343/895; 343/792.5; 343/795
(58) Field of Search ..... 343/792.5, 795, 343/793, 797, 895

(56) References Cited

U.S. PATENT DOCUMENTS

| | | | | |
|---|---|---|---|---|
| 3,013,268 A | | 12/1961 | DuHamel et al. | 343/797 |
| 3,465,346 A | | 9/1969 | Patterson et al. | 343/895 |
| 3,696,437 A | | 10/1972 | Grant | 343/792.5 |
| 4,063,249 A | | 12/1977 | Bergander et al. | 343/756 |
| 4,658,262 A | | 4/1987 | DuHamel | 343/792.5 |
| 5,212,494 A | | 5/1993 | Hofer et al. | 343/859 |
| 5,952,982 A | | 9/1999 | Jorgensen et al. | 343/792.5 |
| 6,011,522 A | | 1/2000 | VanHoozen et al. | 343/792.5 |
| 6,018,323 A | * | 1/2000 | Van Hoozen et al. | 343/792.5 |
| 6,023,250 A | | 2/2000 | Cronyn | 343/895 |
| 6,094,176 A | * | 7/2000 | Van Hoozen et al. | 343/792.5 |

* cited by examiner

*Primary Examiner*—Don Wong
*Assistant Examiner*—Hoang Nguyen
(74) *Attorney, Agent, or Firm*—Drinker Biddle & Keath LLP

(57) ABSTRACT

An antenna comprises a dielectric sheet, a pair of conductive feed stems facing one another on opposite sides of the sheet, and a plurality of conductive antenna elements extending away from each feed stem. Each antenna element on one feed stem forms a pair with an antenna element on the other feed stem. In an embodiment, the antenna comprises four pairs of metal feed stems, radiating from a common center. The antenna elements extend alternately to the two sides of each feed stem. Each antenna element forms a dipole with a matching antenna element directly opposite it on the other feed stem of the same pair. Each pair of feed stems and its antenna elements occupies a quadrant of the antenna. The antenna elements do not overlap with other quadrants. Each antenna element zig-zags so that its electrical length is greater than the distance between its ends. Antenna elements on the same side of a pair of stems form zig-zags that are aligned to minimize variations in the spacing between elements. A coaxial signal feed extends along one feed stem of each pair from the outer end to the center of the antenna, where the outer conductor is connected to one feed stem of the pair and the center conductor is connected to the other feed stem of the pair.

20 Claims, 5 Drawing Sheets

BROADBAND ANTENNA

FIELD OF THE INVENTION

The invention relates to broadband antennas, and especially to a compact, multiply-polarized log-periodic antenna.

BACKGROUND OF THE INVENTION

Log-periodic broadband antennas are known that consist of four radial antenna arms, 90° apart around a common center, from which antenna elements branch off alternately to left and right of each arm. The lengths of the elements, and the spacings between them, increase logarithmically away from the center. The signal feed is usually at the center, with two opposite arms being combined to provide a linearly polarized antenna, or all four to provide a circularly polarized antenna. In order to handle lower frequencies with a physically small antenna, the antenna elements on adjacent arms are sometimes interleaved.

SUMMARY OF THE INVENTION

According to one aspect of the invention, there is provided an antenna comprising a dielectric sheet, and a pair of feed stems facing one another on opposite sides of the sheet. A plurality of antenna elements extend away from each feed stem, each antenna element forming a pair with an antenna element on the other feed stem.

According to another aspect of the invention, there is provided an antenna comprising a feed stem and a plurality of antenna elements extending laterally from the feed stem, wherein the antenna elements are of zig-zag form such that the electrical length of each element is greater than the distance between its ends.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
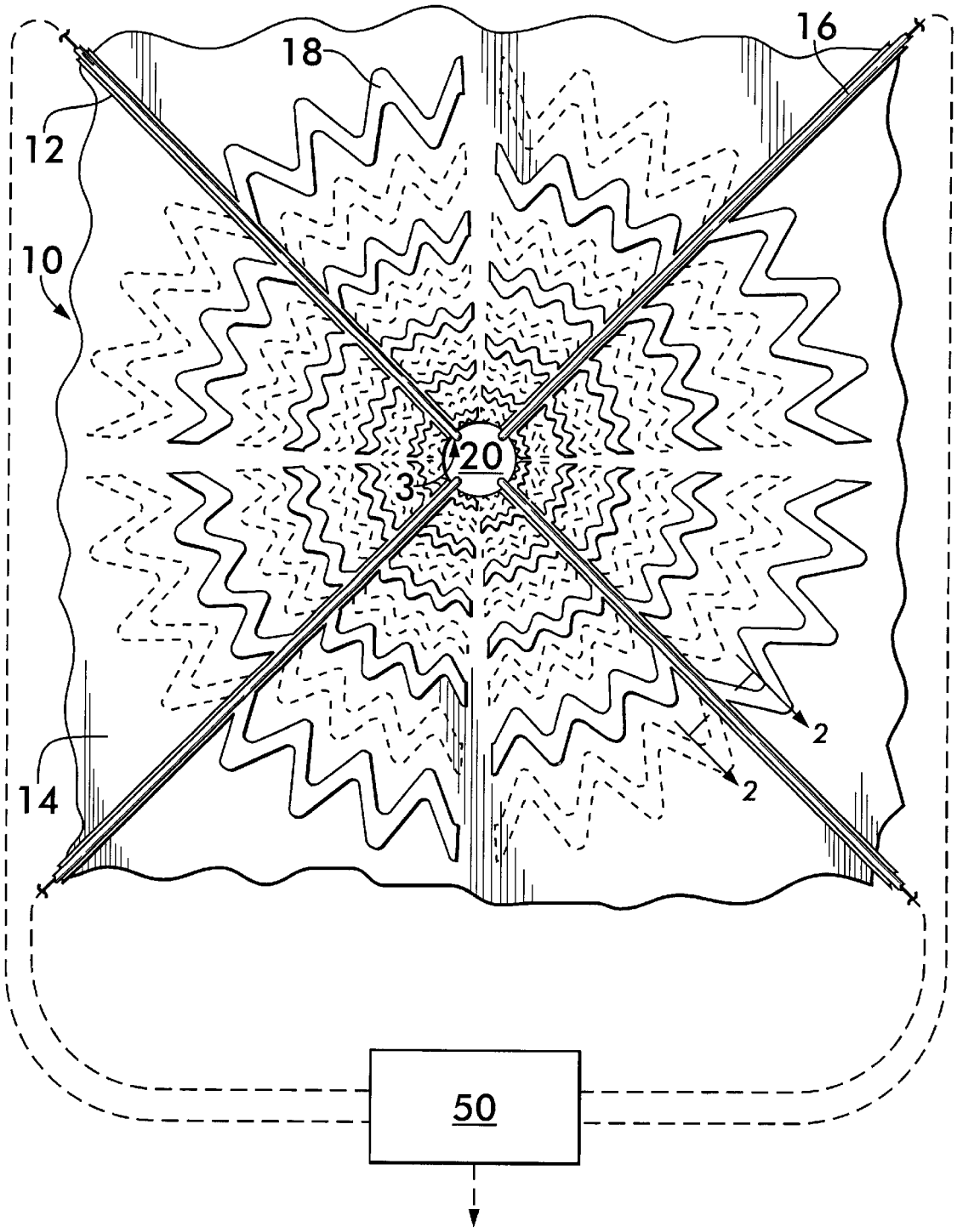
FIG. 1 is a front elevation view of an antenna according to the invention.

Referring to the accompanying drawings, one form of antenna according to the invention is indicated generally by the reference number 10. The antenna 10 comprises eight metal antenna arms, indicated generally by the reference number 12, mounted on a dielectric sheet 14. The manner of fabrication of the antenna may be conventional and, in the interests of conciseness, is not further described. Each antenna arm 12 consists of a central stem 16, with antenna elements 18 branching laterally from it, alternately on the two sides of the stem 16. The arms 12 are positioned with their stems 16 extending radially from the center of the antenna 10, where there is a circular hole 20 in the dielectric sheet 14. The arms 12 are positioned in pairs, on opposite sides of the dielectric sheet 14, and 90° apart around the central hole 20.

Each pair of arms 12 is positioned with the stems 16 of the two arms facing one another on opposite sides of the dielectric sheet 14, and with each antenna element 18 facing a gap between two antenna elements on the paired arm on the opposite side of the sheet. As may be seen from FIG. 1, the elements 18 extend round the antenna for slightly less than 45° away from their stems, so that each pair of arms 12 is spread over a quadrant of the antenna 10 and the elements on different arms do not overlap or interlace. The arms 12 of each pair are identical, if each is viewed from its own side of the dielectric sheet 14. Each pair of arms 12 is the mirror image of the pair of arms in the diametrically opposite quadrant, so that a sum beam, radiating perpendicular to the plane of the antenna, can be produced simply by feeding a signal in phase to two opposite pairs of arms. Alternatively, the arms in opposite quadrants may be identical, in which case an in-phase feed will produce a difference beam and an anti-phase feed will produce the sum beam. By feeding one pair of opposite quadrant antenna arms with a signal to produce a sum beam, and the other pair with a signal to produce a difference beam, or by some more complicated combination of phases, an oblique beam in a desired direction may be generated. That enables directional transmission, or direction finding when the antenna is used as a receiver.

A coaxial feed 22 extends along the stem 16 of one arm 12 of each pair. The outer braid 24 of the feed 22 is mechanically and electrically bonded to the stem 16, as by welding 26. The coaxial feeds 22 are led in at the outer perimeter of the antenna 10, and run the entire length of the stems 16 to the center hole 20. At the center hole 20, the outer braid 24 and the dielectric 28 of each coaxial feed 22 terminate, and the central conductor 30 of the feed is led outwards along the stem 16 of the other antenna arm 12 of the same pair. The central conductor 30 is mechanically and electrically bonded to the stem, as by welding 26. In order to form a symmetrical transmission line along the stems 16, the exposed central conductor 30 is enlarged so as to have the same diameter as the outer braid 24 of the coaxial cable 22 on the other stem 16. The radially positioned coaxial cable 22 also serves as an infinite balun connecting the external feed to the dipoles, eliminating the separate balun that would otherwise have to be provided in the base of the housing.

The antenna elements 18 form pairs, of equal length and extending symmetrically from the two stems 16 of a pair of antenna arms 12. Each such pair of elements 18 forms a dipole. As is known for a log-periodic broadband antenna, both the lengths of the elements 18 and the spacing between successive elements increase away from the center. The elements 18 are of zig-zag shape. This has the effect of increasing the electrical length of the elements over the distance between the ends of the element, and thus reducing the resonant frequency of each dipole. The effective electrical length of the elements is typically slightly less than the geometrical length of the conductive path along the zig-zag. In order to maintain the spacing between adjacent antenna elements 18 on the same side of the same pair of arms, all of the elements have the same number of zig-zags, in the same direction.

The presence of the dielectric 14 reduces the speed of propagation of electromagnetic waves along the elements 18, and further reduces the resonant frequency of each dipole. Thus, the minimum frequency for which the antenna is effective can be reduced considerably below what would normally be expected from the physical size of the antenna. Alternatively, for a particular minimum frequency the antenna can be made smaller. The absolute maximum and minimum frequencies for which the antenna 10 is effective depend primarily on the physical diameters measured over the innermost and outermost dipoles. To symbolize this, the outer edge of the antenna has been shown in FIG. 1 broken away, and not as a structural rim. Antennas have been produced that give 500 MHz operation in a 10" (25 cm) diameter, and 2 GHz operation in a 2.3" (58 mm) diameter.

Because the arms 12 are in pairs, and the pairs of elements 18 form dipoles, each pair of arms 12, occupying one quadrant of the antenna 10, can constitute an independent broadband dipole array. It is not necessary to connect opposite quadrants in 0° or 180° phase to a single feed in order to form an effective antenna. However, it may be preferred to connect opposite quadrants, or all four quadrants, to a single feed with selected phase shifts in order to form a linearly, circularly, or otherwise polarized antenna. An electronics unit 50 may be incorporated in the antenna 10, and may connect the feeds to all four antenna arms 12, optionally with phase shifters and/or switches, to produce a desired beam pattern from a single external feed. Instead, or in addition, the electronics unit 50 may comprise a low-noise amplifier, to offset cable losses between the antenna 10 and the signal receiver. The electronics within the unit 50 may be conventional and, in the interests of clarity, are not shown in detail.

Figure 3:
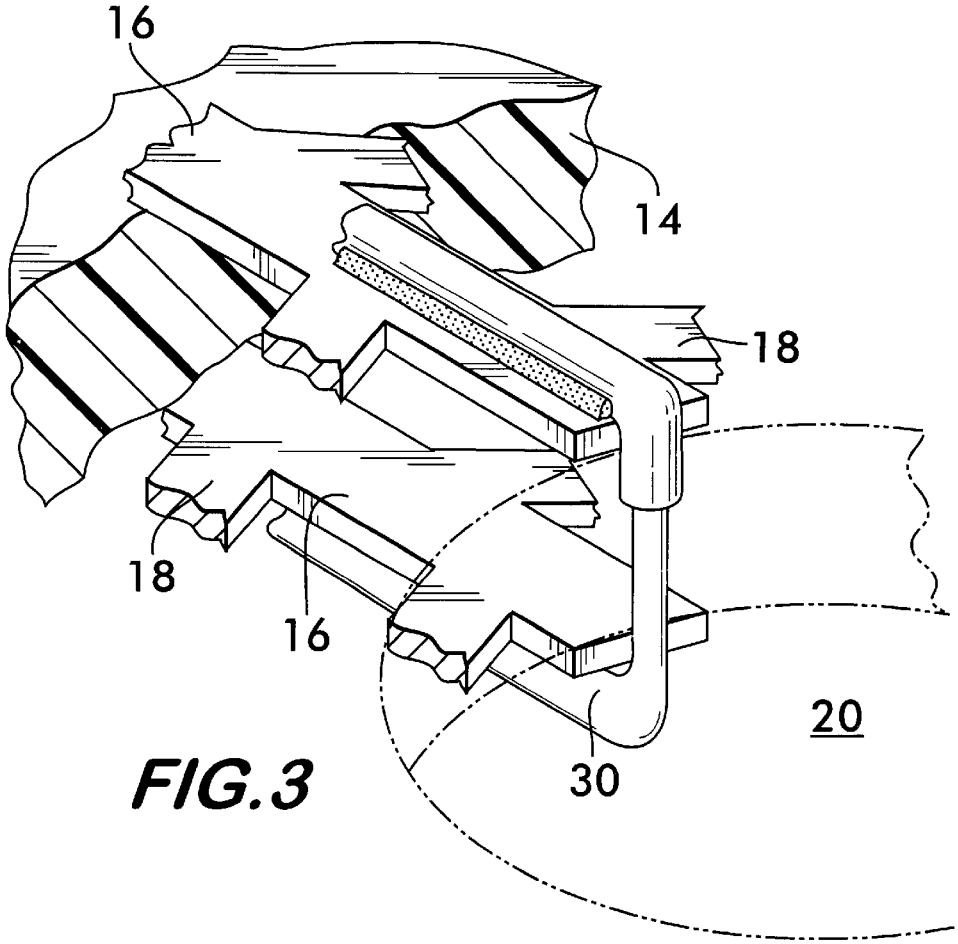
FIG. 3 is a perspective view, partly broken away, of a detail indicated by the reference numeral 3 in FIG. 1.

In order to provide a unidirectional antenna with radiation on only the front side of the antenna, the antenna 10 may include an absorber or reflector 52 defining a cavity 54 (see FIG. 3) on the back side of the antenna. Such cavities are well known in the literature and, in the interests of conciseness, are not further described here.

Figure 2:
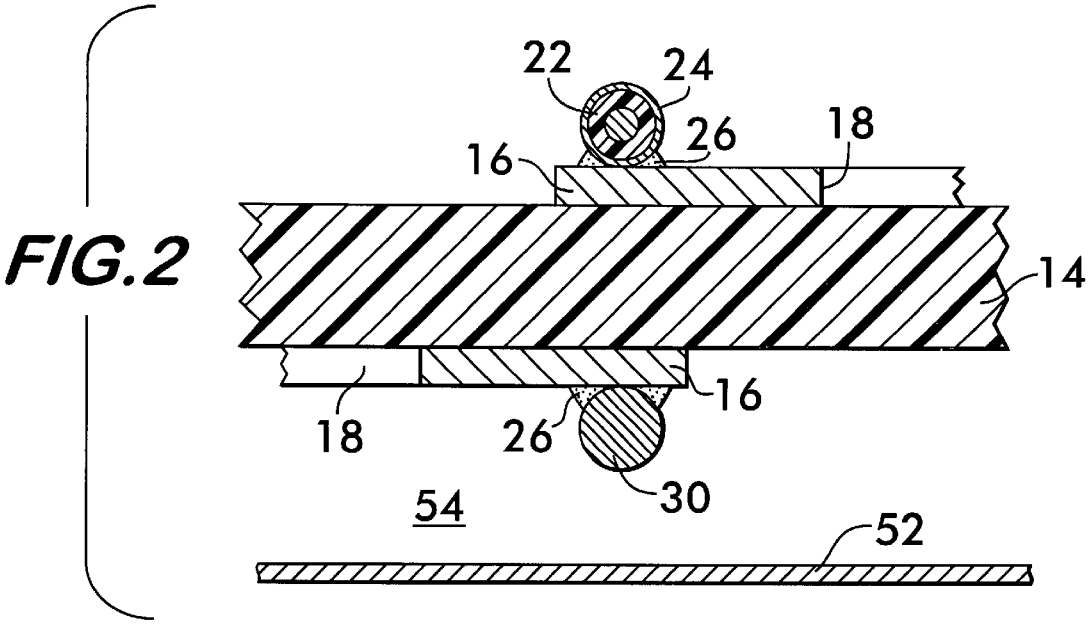
FIG. 2 is a detail section along the line 2—2 of FIG. 1.
Figure 4:
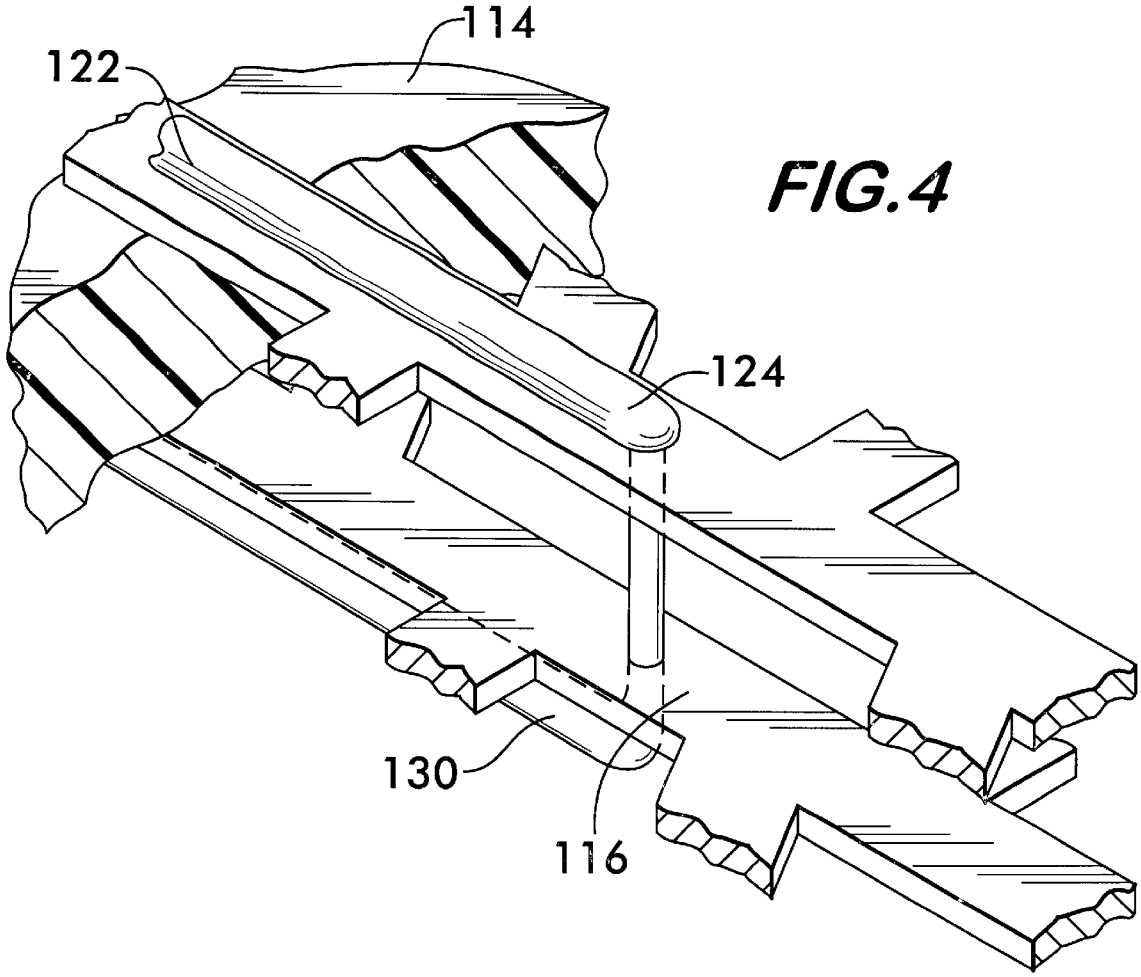
FIG. 4 is a perspective view, partly broken away, similar to FIG. 3, of a detail of an alternative embodiment of the antenna according to the invention.

Referring now to FIG. 4, in a second embodiment of antenna the stems of two opposite antenna arms 112 are continuous end to end, forming a single diametral stem 116 on each side of the dielectric sheet 114. A single coaxial feed 122 is brought to the center of the antenna, the midpoint of the joined stems 116, and the central conductor 130 is brought through the thickness of the dielectric sheet 114 at the midpoint. The central conductor 130 and the outer braid 124 are electrically bonded to their respective stems 116 at that point. The structure of this antenna is otherwise essentially similar to that shown in FIGS. 1 to 3. With the elements 18 of the two ends of each stem 116 mirror-symmetrically arranged, as shown in FIG. 1, the dipoles in opposite quadrants of the antenna radiate in phase, producing a single-mode beam perpendicular to the plane of the antenna. Where that single mode is sufficient, the form of antenna shown in FIG. 4 provides an exceptionally simple implementation. To form the full four-quadrant antenna, two dielectric sheets 114 with antennas as shown in FIG. 4 may simply be superimposed with the stems 116 at right angles.

Figure 5:
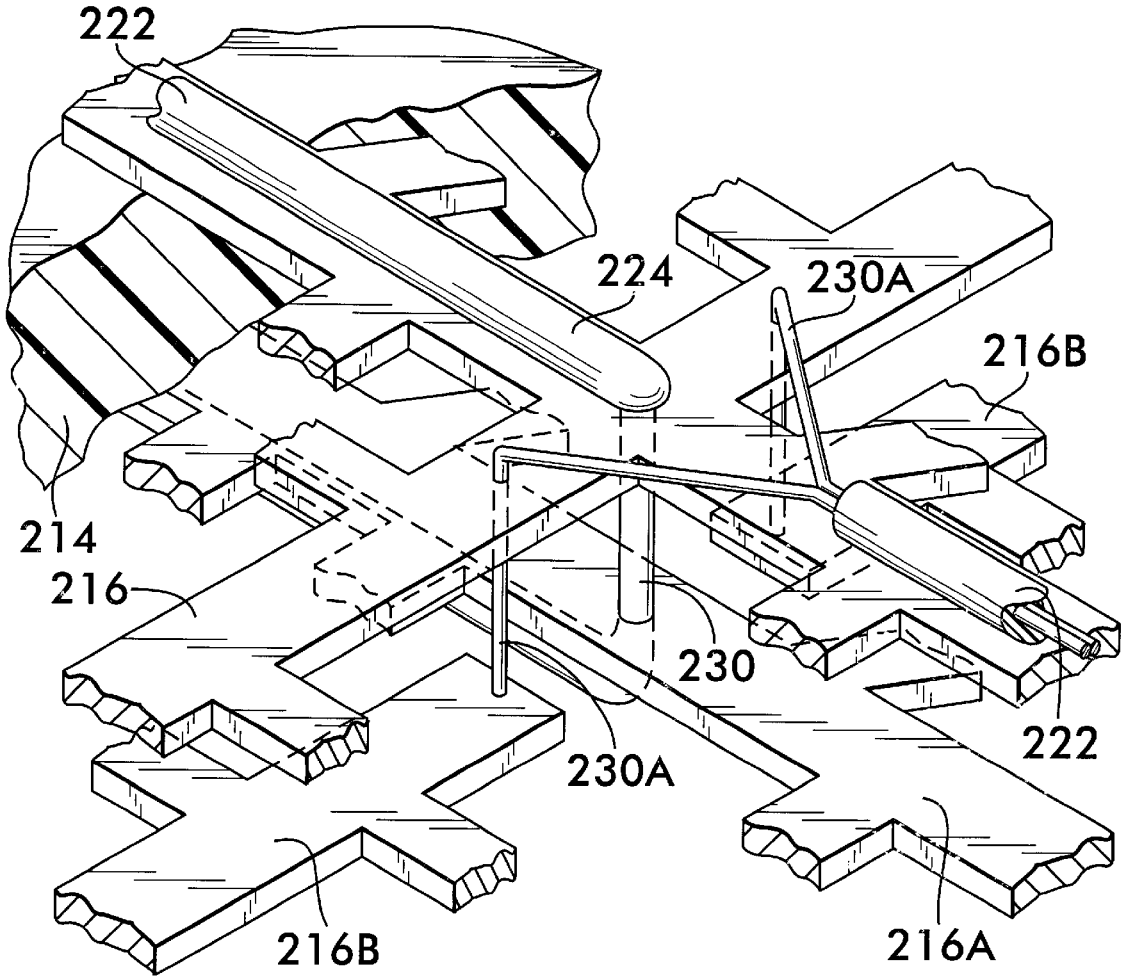
FIG. 5 is a view similar to FIG. 4 of a detail of a third embodiment of the antenna according to the invention.

Referring now to FIG. 5, a third form of antenna embodies the functionality of FIG. 4 with all four quadrants on a single dielectric sheet 214. On one side of the sheet 214, the stems of all four antenna arms 212 are joined together to form a cross 216. On the other side of the dielectric sheet 214, two of the four stems are continuous end to end, forming a diametral stem 216A, and the other two stems 216B are separate, terminating just short of the diametral stem 216A. Two coaxial feeds 222 are brought to the center of the antenna along those arms of the cross 216 that are opposite the diametral stem 216A. The outer braids 224 of the coaxial feeds 222 are bonded to the cross 216 to form an infinite balun, as described above. At the center of the cross 216, the outer braid 224 of one coaxial feed 222 is bonded to the cross 216, and the central conductor 230 is brought through the thickness of the dielectric sheet 214 and is electrically bonded to the diametral stem 216A. This feed, together with the diametral stem 216A and the two arms of the cross 216 that face it, form a pair of antennas in phase similar to that shown in FIG. 4. The central core of the second coaxial feed 222 is divided into two leads 230A. Each of the leads 230A is led through an opening in the cross 216 and through the thickness of the dielectric sheet 214, and is bonded to the inner end of a respective one of the stems 216B. The outer braid 224 of the second coaxial feed 222 is electrically connected to the arms of the cross that face the stems 216B, by virtue of the fact that the cross 216 is continuous. The second coaxial feed 222, together with the stems 216B and the two arms of the cross 216 that face them, form a second pair of antennas in phase, functionally similar to that shown in FIG. 4, and at right angles to the first pair of antennas incorporating the diametral stem 216A. With the elements 18 of each quadrant mirror-symmetrically arranged, as shown in FIG. 1, the dipoles in opposite quadrants of the antenna radiate in phase, producing a single-mode beam perpendicular to the plane of the antenna.

Figure 6:
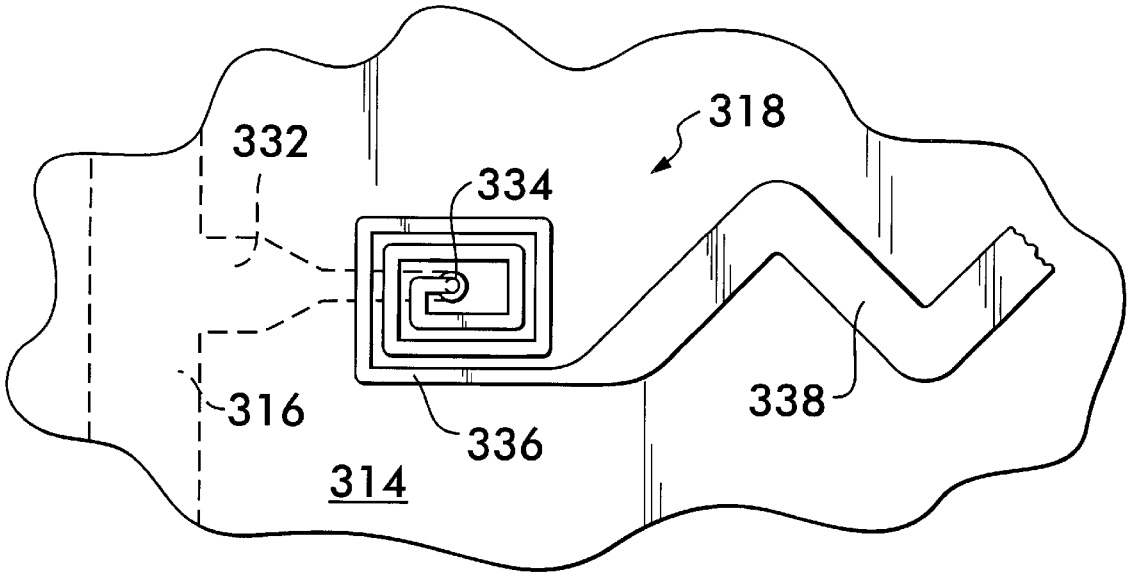
FIG. 6 is a plan view of a detail of a fourth embodiment of the antenna according to the invention.
Figure 7:
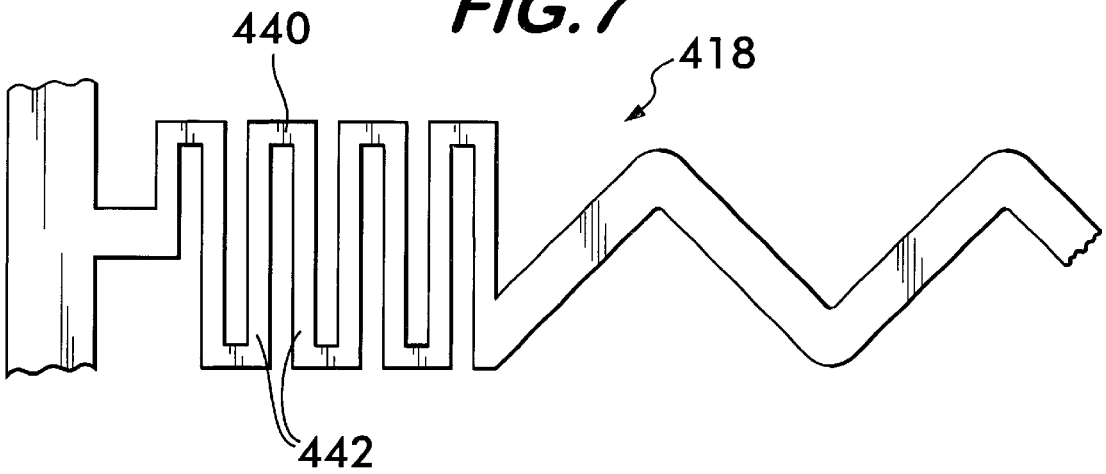
FIG. 7 is a plan view, similar to FIG. 6, of a detail of a fifth embodiment of the antenna according to the invention.

Referring now to FIGS. 6 and 7, if additional loading of some or all of the antenna elements is desired, to give a further decrease in the resonant frequency of a dipole of a particular physical length, then an inductor may be incorporated in the individual antenna element. As shown in FIG. 6, the proximal end 332 of an antenna element 318 is on the same side of the dielectric sheet 314 as is the stem 316 to which that element 318 is attached. The element 318 passes through the thickness of the dielectric sheet 314, by means of a plated-through hole 334 in the dielectric. The element 318 is then formed in a spiral 336 out from the hole 334, before continuing as a straight or zig-zag distal end 338 of the antenna element. As shown in FIG. 7, an antenna element 418 has a portion 440 that is of serpentine construction, with portions 442 that are parallel and close together, to form an inductance. The modified antenna elements 318, 418 shown in FIGS. 6 and 7 may be applied to any of the antennas shown in FIGS. 1 to 5.

Although the invention has been described and illustrated with respect to the exemplary embodiments thereof, it should be understood by those skilled in the art that the foregoing and various other changes, omissions, and additions may be made therein and thereto, without departing from the spirit and scope of the present invention as set forth in the accompanying claims.

For example, instead of using a coaxial feed 22, the stems 16 themselves may be used as a microstrip feed from the outer edge of the antenna.

The exact choice of the electrical lengths and radial spacings of the dipoles may be made to suit the requirements of a particular application. The theory underlying the choice of lengths, and the use of dielectric 14 and inductances to load the antenna elements, is well understood and, in the interests of conciseness, is not further discussed here. In order to increase still further the disparity between the physical and electrical lengths of the antenna elements, capacitative loading, or any other form of loading consistent with the physical structure of the antenna, may be added.

What is claimed is:

1. An antenna comprising:

a feed stem; and plurality of antenna elements extending laterally from the feed stem;

wherein all of the antenna elements are of zig-zag form such that the electrical length of each element is greater than the distance between its ends.

2. An antenna according to claim 1, wherein the antenna elements of each pair are of equal electrical length and extend in opposite directions away from the feed stems.

3. An antenna according to claim 1, wherein the antenna elements extending from each feed stem extend alternately to opposite sides of the feed stem.

4. An antenna according to claim 3, wherein each antenna element extends from its stem directly opposite an antenna element extending from the other stem of the pair.

5. An antenna according to claim 1, wherein the lengths of the antenna elements increase progressively from one end of the feed stems to the other end.

6. An antenna according to claim 1, wherein the antenna elements on the same side of the stems form zig-zags that are so aligned as to tend to minimize variations in the distance between adjacent elements caused by the zig-zags.

7. An antenna according to claim 1, further comprising a connection for a signal feed to the two feed stems.

8. An antenna according to claim 1, wherein the antenna elements extend from opposite sides of the feed stem.

9. An antenna according to claim 8, which comprises a plurality of feed stems radiating in different directions from a common center, and wherein antenna elements extending from adjacent feed stems do not overlap circumferentially.

10. An antenna according to claim 1, comprising:

a dielectric sheet;

a pair of said feed stems facing one another on opposite sides of the sheet; and a said plurality of antenna elements extending away from each feed stem, each antenna element on one feed stem forming a pair with an antenna element on the other feed stem.

11. An antenna comprising:

a dielectric sheet;

a pair of conductive feed stems facing one another on opposite sides of the sheet;

a plurality of conductive antenna elements extending away from each feed stem, each antenna element on one feed stem forming a pair with an antenna element on the other feed stem; and a coaxial transmission line for a signal feed to the two feed stems with the outer conductor connected to one feed stem and the center conductor connected to the other feed stem.

12. An antenna according to claim 11, wherein the coaxial transmission line extends along the said one feed stem to form an infinite balun.

13. An antenna comprising:

a dielectric sheet;

at least two pairs of conductive feed stems, the stems of each pair facing one another on opposite sides of the sheet and the pairs of feed stems radiating from a common center;

a plurality of conductive antenna elements extending away from each feed stem, each antenna element on one feed stem forming a pair with an antenna element on the other feed stem of the same pair of feed stems and said antenna elements extending generally circumferentially about said common center; and a connection for a signal feed at the outer end of each pair of feed stems.

14. An antenna according to claim 13, wherein each pair of feed stems and its antenna elements occupies a respective sector of the antenna, and the antenna elements do not overlap with other sectors.

15. An antenna according to claim 13, wherein there are four pairs of feed stems, and the antenna elements occupy quadrants centered on their respective feed stems.

16. An antenna according to claim 13, wherein each connection comprises a coaxial transmission line extending along one feed stem of each pair from the outer end.

17. An antenna according to claim 16, wherein each coaxial transmission line extends to the inner end of the feed stems, where the outer conductor is electrically connected to one feed stem of the pair and the center conductor is electrically connected to the other feed stem of the pair.

18. An antenna comprising:

a dielectric sheet;

at least two pairs of conductive feed stems, the stems of each pair facing one another on opposite sides of the sheet and the pairs of feed stems radiating from a common center;

a plurality of conductive antenna elements extending away from each feed stem, each antenna element on one feed stem forming a pair with an antenna element on the other feed stem of the same pair of feed stems and said antenna elements extending generally circumferentially about said common center; and wherein two opposite pairs of feed stems are continuous end to end to form a pair of diametral feed stems, and comprising a connection for a signal feed to the pair of diametral feed stems at the center.

19. An antenna according to claim 18, further comprising third and fourth pairs of feed stems perpendicular to the diametral feed stems and a connection for a second signal feed common to said third and fourth pairs of feed stems, and wherein one feed stem of each of said third and fourth pairs is continuous with one of the diametral feed stems.

20. An antenna comprising:

a dielectric sheet;

four pairs of conductive feed stems, radiating from a common center, the feed stems of each pair facing one another on opposite sides of the sheet;

a plurality of conductive antenna elements connected to and extending away from each feed stem alternately to the two sides of the feed stem, wherein each antenna element forms a dipole with an antenna element of equal length extending opposite it from the other stem of the same pair, and wherein each pair of feed stems and its antenna elements occupies a respective quadrant of the antenna centered on the pair of feed stems, and the antenna elements do not overlap with other quadrants; and a connection for a signal feed at the outer end of each pair of feed stems, wherein each connection comprises a coaxial feed extending along one feed stem of each pair from the outer end to a point at which the outer conductor is electrically connected to one feed stem of the pair and the center conductor is electrically connected to the other feed stem of the pair;

wherein the lengths of the antenna elements increase progressively from the inner ends of the feed stems to the outer ends; and wherein each antenna element is of zig-zag form such that its electrical length is greater than the distance between its ends, and the antenna elements on the same side of a pair of stems form zig-zags that are in step with one another such as to tend to minimize variations in the distance between adjacent elements caused by the zig-zags.

* * * * *

UNITED STATES PATENT AND TRADEMARK OFFICE

CERTIFICATE OF CORRECTION

PATENT NO. : 6,362,796 B1
DATED : March 26, 2002
INVENTOR(S) : Walter Bohlman

It is certified that error appears in the above-identified patent and that said Letters Patent is hereby corrected as shown below:

Title page,
Item "[74] *Attorney, Agent, or Firm* - Drinker Biddle & Keath LLP" to
-- [74] *Attorney, Agent, or Firm* - Drinker Biddle & Reath LLP --

Signed and Sealed this

Eighteenth Day of June, 2002

*Attest:*

*Attesting Officer*

JAMES E. ROGAN
*Director of the United States Patent and Trademark Office*